United States Patent [19]

Kelchner, Jr.

[11] Patent Number: 4,662,836

[45] Date of Patent: May 5, 1987

[54] NON-WOVEN SHEET BY IN-SITU FIBERIZATION

[75] Inventor: Raymond E. Kelchner, Jr., Los Angeles, Calif.

[73] Assignee: Hughes Aircraft Company, Los Angeles, Calif.

[21] Appl. No.: 801,022

[22] Filed: Nov. 22, 1985

Related U.S. Application Data

[62] Division of Ser. No. 636,447, Jul. 31, 1984, Pat. No. 4,581,185.

[51] Int. Cl.[4] ..... B29C 33/42

[52] U.S. Cl. ..... 425/223; 264/23

[58] Field of Search ..... 264/23, 9; 425/223

[56] References Cited

U.S. PATENT DOCUMENTS

| | | | |
|---|---|---|---|
| 2,398,455 | 4/1946 | Unger | 264/23 |
| 2,544,622 | 3/1951 | Ulmer et al. | 264/23 |
| 2,717,474 | 9/1955 | Barradel-Smith | 264/23 |
| 2,939,223 | 6/1960 | Smith | 264/23 |
| 3,060,501 | 10/1962 | Beal | 264/184 |
| 3,285,442 | 11/1966 | Tigner | 264/23 |
| 3,454,687 | 7/1969 | Ciofani | 264/216 |
| 3,515,778 | 6/1970 | Field et al. | 425/223 |
| 3,524,753 | 8/1970 | Sharp | 264/216 |
| 3,614,809 | 10/1971 | Hayes et al. | 425/223 |
| 4,127,624 | 11/1978 | Keller et al. | 264/23 |
| 4,198,461 | 4/1980 | Keller et al. | 264/23 |
| 4,279,855 | 7/1981 | Ward | 264/216 |
| 4,292,016 | 9/1981 | Elliott | 425/223 |
| 4,298,557 | 11/1981 | Bradford et al. | 264/216 |
| 4,397,907 | 8/1983 | Rosser et al. | 264/22 |
| 4,403,069 | 9/1983 | Keller et al. | 264/23 |
| 4,440,819 | 4/1984 | Rosser et al. | 264/23 |
| 4,455,273 | 6/1984 | Harpell et al. | 264/203 |
| 4,551,296 | 11/1985 | Kavesh et al. | 264/203 |

*Primary Examiner*—Tim Miles

*Attorney, Agent, or Firm*—M. E. Lachman; A. W. Karambelas

[57] ABSTRACT

A polymeric fibrous sheet is provided in the form of a composite of an open matrix of coarse fibers extending throughout the sheet and integrated with co-crystallized, fine fibers spanning the open spaces within the matrix. This non-woven sheet is formed by applying a thin film of polymer solution to the top surface of a substrate undergoing agitation. The substrate can be continuous, such as a belt, agitated by applying oscillatory motion from an acoustic or pneumatic driver to the shafts carrying the cylindrical rollers for the belt. The agitation is at a level sufficient to develop a reciprocating flow field with a velocity gradient sufficient to uncoil and orient the polymer chains in solution and induce the growth of fibers. As the agitated solution cools, a sheet is formed as linear polymer chains crystallize. Residual solvent is removed and the sheet is then dried in the dryer. Sheets with higher fiber content and strength are produced by using substrates containing grooves, especially substrates containing a second set of grooves normal to the first set of grooves, formed by a pattern of raised protrusions. The sheet produced using the patterned substrate contains a network of coarse fibers which roughly replicate the pattern of the grooves.

12 Claims, 19 Drawing Figures

20X

5000X

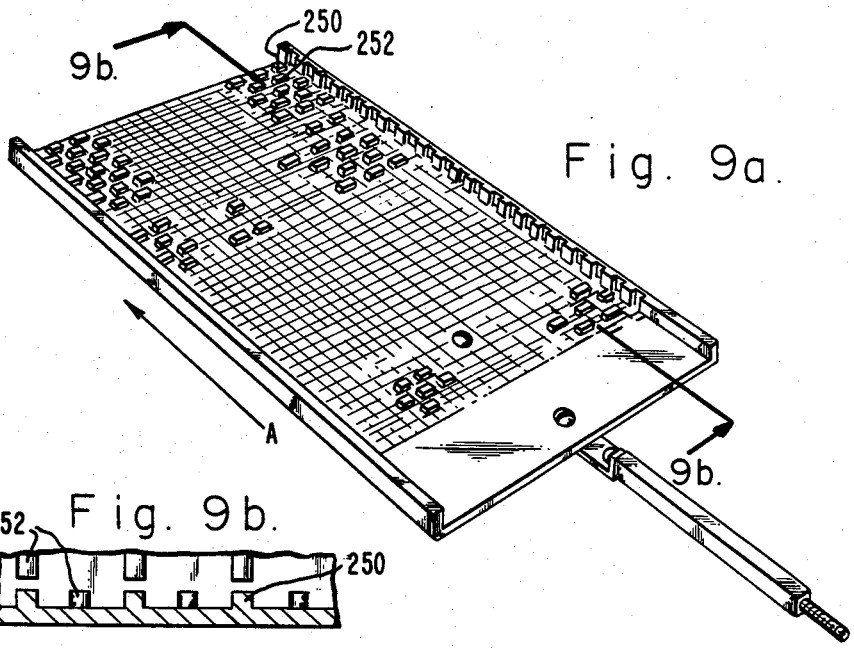
Fig. 9a.
Fig. 9b.
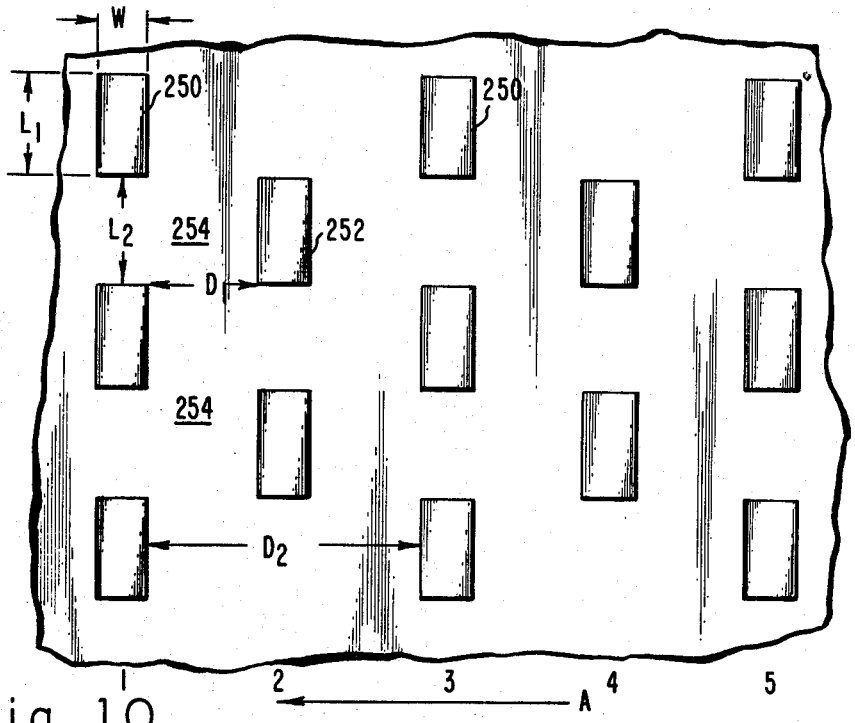
Fig. 10.

NON-WOVEN SHEET BY IN-SITU FIBERIZATION

This is a division of application Ser. No. 636,447, filed July 31, 1984, now U.S. Pat. No. 4,581,185.

BACKGROUND OF THE INVENTION

1. Field of the Invention

This invention relates to the fabrication of non-woven, polymeric fabrics, and more particularly, this invention relates to the production of a polymeric fibrous sheet by a single step in-situ fiberization technique.

2. Description of the Background Art

Fabrics can be produced from polymers by weaving, knitting or non-woven techniques. All fabric-forming techniques require polymerization, polymer recovery and formation of filaments. In woven and knitted fabrics, the polymer is processed into filament and then into a multi-filament yarn before being woven or knitted into a fabric by interlacement of warp and weft threads. Non-woven fabrics are manufactured from a web, sheet or batt of chopped fibers that are joined by mechanical, chemical or solvent processes. Barbed needles have been used to punch into a web of fibers to entangle them. The fibers can be bonded into a felt by applying heat, moisture and pressure to a sheet of fibers. The term non-woven is also applied to fabrics comprising a web of fibers held together by sticking. The non-woven fabrics are very soft but have very little overall strength. All of these fabric forming techniques are capital and labor intensive, requiring complex multi-stage processing to convert raw polymer stock into knitted or woven fabric or a non-woven fibrous sheet.

A one-step process for forming shaped, fibrous polymer networks is disclosed in U.S. Pat. Nos. 4,127,624; 4,198,461; 4,397,907; and 4,403,069 by an insitu fiberization (ISF) technique by agitation-induced crystallization of the fibers from solution. The fibers form a coherent, three-dimensional, isotropic network of crystalline fiber bundles. The three-dimensional mass of fibers is produced by cooling a container of the solution being agitated at sonic frequency. This ISF technique can be used to form a fiber mass which may subsequently be impregnated with a curable polymeric resin to provide a fiber-reinforced composite useful as a structural material or as a high strength encapsulant for electronic components. In addition, the fiber mass so formed may be broken into individual fibers or fiber bundles which are useful for forming papers, cloths, felts, mats, non-woven fabrics, cordage, and the like.

However, using these known ISF techniques, it has been found difficult to provide the fiber product in sheet form. Since the fiber product conforms to the shape of the container in which it is formed, production of self-supporting thin sheets by agitating the bulk of the solution would require closely-spaced walls to provide a narrow sheet-forming channel. Under such conditions, the generation of a fiber-forming flow field would be inhibited because of large capillary forces acting on the solution. Any material that would form under such conditions would be difficult to recover from the narrow, sheet-forming channel.

On the other hand, production of thin fiber sheets on a substrate submersed in a bulk solution would require a porous substrate surface to generate the required flow field and to prevent shake-off or dispersion of the product. In this case, the fiberized material would form as a mass entangled with the substrate and would resist separation by peeling.

SUMMARY OF THE INVENTION

It has now been discovered in accordance with the present invention that a fibrous sheet can be grown from a film of solution on a planar, agitated surface without the necessity of an opposed surface or porous substrate. A thin film of polymer solution is applied to the surface. Reciprocating motion of the surface creates a flow field in the solution throughout its bulk up to the upper surface-interface with air. The structure of the flow field in this case is essentially governed by the agitating surface-solution interface because the opposite air-solution interface is of low friction. Cooling of the solution to a temperature at which the polymer can be crystallized from solution while inducing velocity gradients sufficient to uncoil and orient the polymer chains in the solution results in the formation of a porous sheet with an interconnected network of fibers. (Velocity gradient is used herein to mean the change in velocity of fluid propagation with change in position in space. Flow field is used herein to mean the velocity, pressure, and density of a fluid as functions of position in space and time.)

Fiberization can be performed by simultaneous cooling and agitation of the solution, as previously described, which is the preferred method when fast-rate processing is required. In such a process, the film is allowed to cool to the temperature of the substrate. Alternatively, fiberization can be performed by isothermal agitation at a constant solution temperature which is a few degrees (e.g. 5° to 10° C.) above the supercooled temperature (i.e. the temperature at which the polymer crystallizes from solution). The temperature of the film of solution on the substrate is controlled by controlling the temperature of the substrate by known methods. The isothermal fiberization technique can be used to eliminate low molecular weight species from the product by fractionation. In the isothermal agitation method, the mechanical energy provided by the agitation causes the polymer to crystallize from solution at a temperature above its supercooled temperature. In addition, the agitation produces velocity gradients sufficient to uncoil and orient the polymer chains in solution to provide the interconnected network of fibers as previously discussed.

Sheet formation occurs within seconds of applying the thin film of solution to the reciprocated surface The process results in the direct formation of a non-woven sheet material in a single step. The process can be performed continuously or by automated batch methods The process is highly efficient using small amounts of solvent and converts nearly all the dissolved polymer into fibrous sheet product. The production rate of growing fibrous sheet is similar to the rate of weaving or knitting fabrics since the thin film fiberization occurs so rapidly. The process of the invention involves lower capital cost and is less labor intensive than the production of woven or non-woven fabrics. The sheet material of the invention can be varied from very soft, thin, low tensile materials to thicker materials having much higher tensile strength.

The polymeric fibrous sheet materials are produced in a growth process by flow-enhanced crystallization of the polymer from solution. The sheet materials have a new structure in the form of a composite of a fine fiber network integrated with a coarse fiber network. The fine fibers will typically have diameters of about 1 micrometer or less and the coarse fibers will have diameters of about 10 micrometers or greater. The two network types are intimately associated through molecular interconnections having been formed by co-crystallization. The result is a non-woven, filet-like material with an interconnected fine fiber damask integrated with an interconnected coarse fiber ground. Significantly, a fabric is produced by this invention that is very lightweight, less than 0.5 ounces per square yard, yet very dense, with pore sizes of about 1 millimeter.

This unique product is produced directly in sheet form by applying a thin layer of hot polymer solution to a flat surface or plate undergoing reciprocation. The plate surface can be grooved or textured to enhance the flow field in the layer of solution. The texture of the surface creates localized flow fields which produce a sheet product that macroscopically replicates the plate pattern.

The process involves the transformation of polymer molecules into a molecularly integrated filet of fiber networks through multi-interface flow field generation, namely, flow gradients at the solution-plate interfaces of varying geometries. The macroscopic structure or pattern in the final sheet product depends on the pattern present in the agitation plate surface. The process can produce sheet product from any linear, crystalline polymer that can be precipitated from solution. In addition, materials such as activated carbon can be dispersed in the fiber forming solution to produce a thin sheet of fiber-particle composite.

The porous, fibrous sheets of the invention can be utilized in the same manner as prior non-woven fabrics such as insulation, or as vapor or moisture transmissive sheets. The wicking properties of polypropylene renders the thin film fiberized sheets of the invention useful in manufacture of disposable diapers and in surgical gauzes.

These and many other features and attendant advantages of the invention will become apparent as the invention becomes better understood by reference to the following detailed description when considered in conjunction with the accompanying drawings.

BRIEF DESCRIPTION OF THE DRAWINGS

FIG. 9*a*–9*b* is a top view of a patterned substrate for forming thin film fiberized sheets.

FIG. 10 is a top schematic view of the patterned substrate of FIG. 9, with a surface pattern of rectangular cleats.

DETAILED DESCRIPTION OF THE INVENTION

Polymeric fibrous sheet is fabricated in accordance with the present invention by applying a thin film of polymer solution to a planar surface that is being reciprocated at an amplitude and frequency sufficient to develop a flow field with velocity gradient capable of inducing growth of fibers. The substrate is agitated at frequencies below 1000 hertz (Hz) and amplitudes in excess of 1/16 inch (0.15 cm). The substrate can be formed of any material that will part from and release the sheet of fibers. Suitable materials include, but are not limited to, metals and plastics. The surface can be flat and continuous as in a belt or a cylinder. The film can be formed on the inside or outside surface of a cylinder. The substrate can contain edge runners to retain the agitated solution in place during formation of thicker sheets of fiber.

The mixture of polymer and solvent is heated to a temperature necessary to dissolve the polymer. The solution usually contains from 0.1 to 10 percent polymer, preferably from 0.5 to 5 percent polymer.

Polymers which are highly suitable for this invention are high molecular weight, non cross-linked or linear polymers having a high degree of crystallinity, suitably polyalkenes, such as polyethylene, polypropylene, polybutene, poly(4-methyl-1-pentene) and so forth. Also, linear polymers such as polyvinylidene fluoride, polychlorotrifluoroethylene, and linear polyesters, and acrylics of polyamides may be used. Copolymers of the alkene monomers may also be used, such as propylene-acrylic acid copolymers.

A processing solvent whose boiling point is moderately high, such as mixed xylene, styrene or decalin, is selected for compatibility with the polymer selected to form the fibrous mass. After cooling to ambient temperatures, the primary solvent is removed from the precipitated fibrous mass by extraction or washing with a low boiling solvent such as pentane, methanol, or acetone followed by a drying step.

The reciprocation or oscillation of the surface upon which fiberization is effected is applied at least in one direction. The film has a much greater width (W) than height (H), the ratio W/H being at least 2/1, preferably at least 10/1. The film can be very thin, of the order of 0.1 cm or less. Maximum height is dictated by processing limitations. The height of the film can be built up by multiple stages of fiberization in which a formed sheet can be utilized as the base for further fiberization in the next stage to build up additional height.

Figure 1:
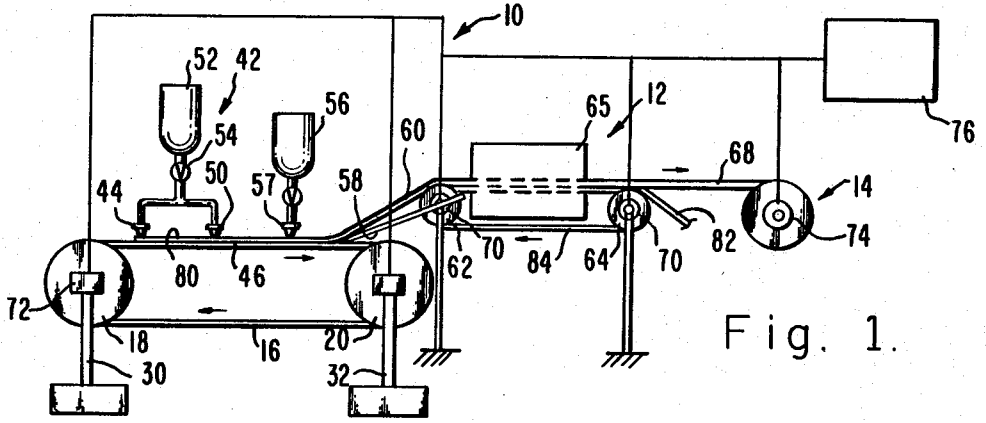
FIG. 1 is a side schematic view of a mechanism for the fabrication of continuous sheets by thin film fiberization according to the invention.
Figure 2:
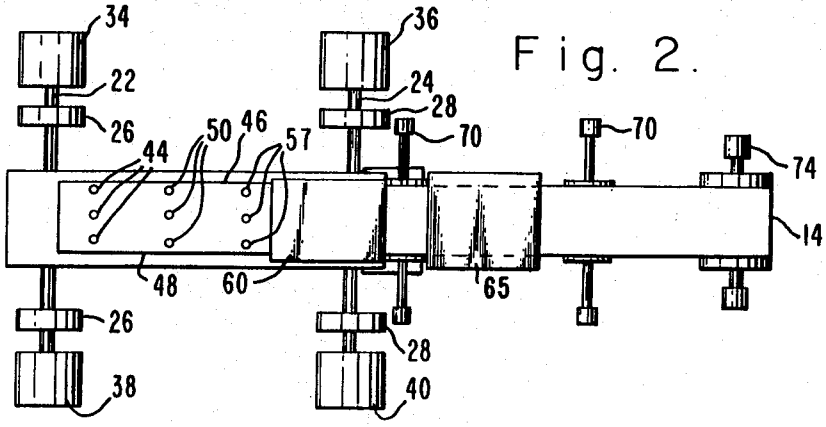
FIG. 2 is a top view of the mechanism of FIG. 1.

An exemplary mechanism for thin film fiberization is shown in FIGS. 1 and 2, which are of a schematic nature only and not intended to provide specific limitations to the present invention as previously described in general terms. The apparatus includes a film forming station 10, drying section 12 connected to the drive take-up reel 14. The substrate is in the form of a continuous belt 16 disposed on a set of cylindrical rollers 18, 20, each rotatably mounted on a central, journalled shaft 22, 24. The shaft extensions on each side of the cylinders pass through guide members 26, 28. The guide members are connected to support stands 30, 32. One end of each shaft is mounted in a bearing assembly 34, 36, while the other end is attached to an agitation mechanism 38, 40 such as an acoustic or pneumatic driver.

A solution applicator assembly 42 contains dispensing means, such as a plurality of nozzle heads 44, positioned over the leading edge of the belt 16 or upstream surface of the belt 16 near cylindrical roller 18. The dispensing means could also take the form of a feeder having a thin slot overlying the belt 16. The belt may contain edge runners 46, 48. The solution could be applied to more than one position of the belt by positioning a second set of nozzle heads 50 downstream from the first set of nozzle heads 44. The nozzle heads 44, 50 are connected to a heated tank 52 containing the polymer solution by a conduit containing a metering valve 54.

Another tank 56 containing a vaporizable non-solvent is connected to a set of nozzles 57 positioned near the downstream cylindrical roller 20. The doctor blade 58 separates the formed sheet 60 from the belt 16 and moves it onto belt 84. The sheet 60 then passes by means of rollers 62, 64 through oven 65 to form a dried fibrous sheet 68. The sheet 68 is then wound up on take-up reel 14. The drives 70, 72 and 74 for rollers 62, 64 and cylindrical rollers 18, 20 and reel 14, respectively, can all be connected to common speed controller 76. Another skimming blade 82 may be utilized to remove the sheet 60 from the rotating belt 84 in the drier 12 before transfer to the pick-up roller 14.

The mechanism of FIGS. 1 and 2 is operated by actuating the acoustic drivers 38, 40 and controller 76 to initiate rotation of the cylinders 18, 20, and 62, 64 and take-up reel 14. The metering valve 54 is actuated to flow a film 80 of solution onto the upstream surface of the belt 16. The film 80 will spread outward to the runners 46, 48. Actuation of the agitation mechanism agitates the film of solution on the belt 16. The acoustic drivers 38, 40 are actuated to horizontally reciprocate the shafts 22, 24 within the bearing assemblies 36, 34 and through the guide members 26, 28. The cylinders 18, 20 are reciprocated by the shaft and, in turn, impart oscillatory motion to the belt 16. As the solution cools, the linear polymer chains uncoil and precipitate under the influence of the agitation. The polymer chains form fibers which interconnect into a network in the form of a porous, thin sheet 60. The residual solvent is removed by spraying the sheet with non-solvent from spray nozzles 57. The sheet is then dried in drier 12.

Figure 3:
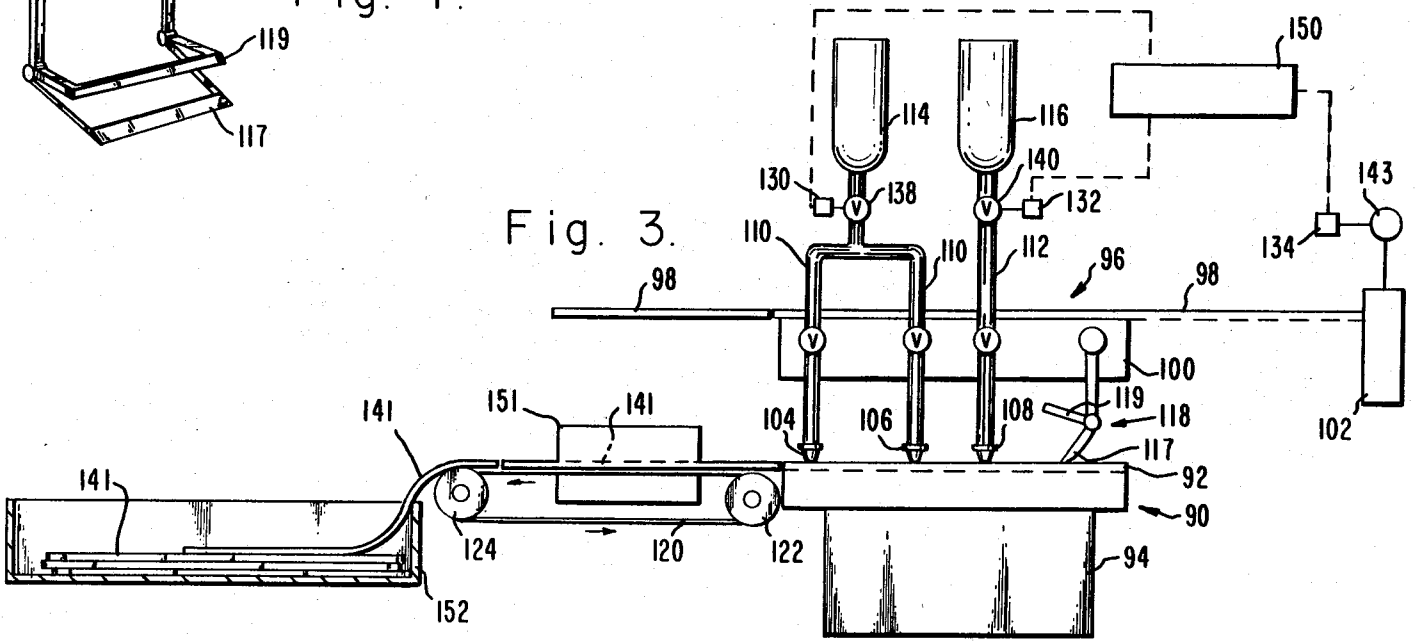
FIG. 3 is a schematic view of a semi-continuous system for the thin film fiberization of polymer solution to form porous fibrous sheets.
Figure 4:
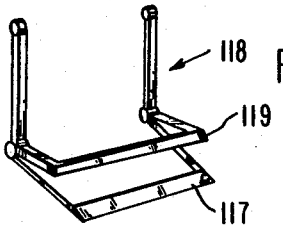
FIG. 4 is a schematic diagram of the skimmer mechanism of FIG. 3.

Sheet fiberization can also be performed on a stationary shaker table 90 as shown in FIG. 3. The table may be provided with a rim 92 to permit formation of sheets of varying thicknesses. The table is mounted on a reciprocating driver 94. A carrier assembly 96 on a track 98 is positioned over the table. The carrier 100 is connected to a reciprocating mechanism 102 which translates the carrier 100 back and forth on track 98 over the table 90. The solution spray nozzles 104, 106 and solvent nozzles 108 are mounted on the carrier and connected through flexible hoses 110, 112 to solution tank 114 and exchange solvent tank 116. A skimmer mechanism 118 is also mounted on the carrier 100. As shown in detail in FIG. 4, the skimmer mechanism 118 comprises a skimmer blade 117 which separates the formed sheet from the surface of the shaker table 90, and a colinear compression bar 119 which can be activated to press down on and grip the formed sheet when the end of the table 90 is reached, to transfer the sheet to a conveyor belt 120 which is positioned at the end of the table 90 and is mounted on rollers 122, 124. The servomechanisms 130, 132, 134 for valves 138, 140 and the motor 143 for reciprocating mechanism 102 are all controlled to sequencing controller 150 which contains logic control for operating the system. Such sequencing controllers can be constructed from readily available commercial instrumentation. The system is operated by opening valve 138 to spray solution out of nozzles 104, 106 and translating the carrier 100 on track 98 to the right until a film of solution fills the casting cavity formed by the table and edges. The table 90 is agitated until fibrous sheet forms. The valve 138 is then closed and valve 140 is opened to spray exchange solvent from nozzle 108 on the sheet, and the carrier is moved to the left with the skimmer blade 117 separating the sheet from the surface of the table. The separated sheet 141 is then gripped between the skimmer blade 117 and the compression bar 119 and transferred onto the conveyor belt 120 which carries it through the dryer 151 and to the packing station 152. Optionally, translation of the carrier 100 back and forth on track 98 may be replaced by rotation of a carousel carrier structure over the table 90 to provide the series of processing steps previously described.

As described in greater detail in the Examples, thin film fiberization was performed using an MB Electronics Model No. PM 50 exciter to produce fiberization either on a small agitated rectangular aluminum coupon of about 1×2.5 inches (2.54×6.35 cm) or on 3×8 inch (7.62×20.32 cm) aluminum plates. The edges of the plates in the long direction are bent upward to provide ¼ inch (0.635 cm) side walls. The side walls restrict the flow-off of fiber forming solution during fiberization. On some plates, grooves were scribed in the top surface of the plate, about 1 mil (0.00254 mm) deep and ⅛ inch (3.175 mm) apart, in the transverse or 3-inch dimension. The grooves enhance the generation of a flow field in the film of solution upon agitation.

Thin film fiberizations of polypropylene solutions were generally performed as follows. An 0.5 to 2 percent w/V polymer (xylene) solution at 125° C. was quickly poured onto the coupon or plate undergoing agitation to produce a uniform coating of the surface. The plate was agitated in a direction normal to the grooves, at a frequency of 50 Hz and displacement of 0.3 inch (0.762 cm). The fiberization was allowed to proceed until a gelatinous film formed, normally 10 to 15 seconds. Subsequently, the film was removed by manually lifting, peeling, or sliding it from the surface. The film was placed in an extraction solvent such as acetone or methanol to remove the xylene. Further details of successive experiments are discussed below.

EXAMPLE 1

Initial fiberization experiments were performed by pouring a 2 percent w/V polypropylene solution in xylene at 125° C. onto the smooth surface of the agitated coupon. This resulted in a very thin, gelatinous film being formed in a very few seconds which dried to a tissue-like sheet of low fiber content. The absence of side restraints allowed excess solution to pour off the sides of the coupon. The agitation generates flow fields and velocity gradients in the thin layer.

EXAMPLE 2

The surface of the coupon was then roughened with a file in order to further enhance the flow field in the solution. The modified coupon was agitated and the hot polypropylene solution poured onto the surface. A fibrous sheet formed having higher fiber content than the sheet of Example 1. The sheet had improved tensile strength and scanning electron microscope (SEM) examination revealed the sheet to be characterized by an interconnected fiber structure.

EXAMPLE 3

The effect of the substrate surface on flow fields in thicker films of solution was then investigated on grooved aluminum plates.

Figure 5B:
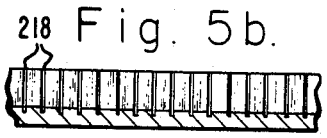
FIG. 5*a*–5*b* a top view of a first grooved substrate for forming thin film fiberized sheets.
Figure 5A:
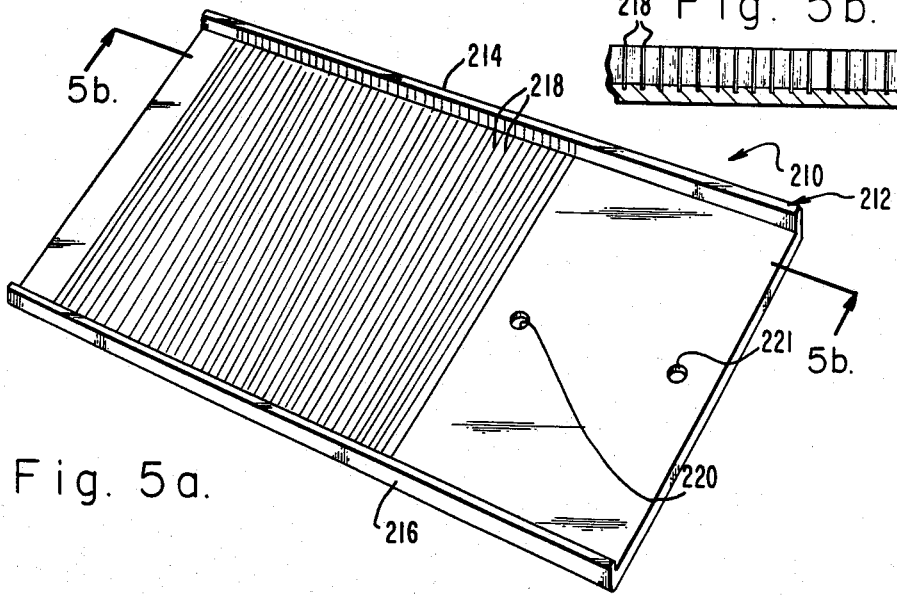

Referring to FIG. 5, a substrate 210 is in the form of an aluminum plate 212 having side edges bent upwardly to form side walls 214, 216 in the long direction. The side walls restrict flow-off of the hot solution during the fiberization. Grooves 218 are scribed in the top surface of the plate in a direction perpendicular to the direction of reciprocation of the plate. The grooves are approximately 1 mil (0.00254 cm) deep and ⅛ inch (0.317 cm) apart to enhance generation of the flow field. The plate was attached to the MB Electronics exciter by bolts, not shown, connected through the drilled holes, 220 and 221.

A series of experiments was performed by pouring 2 percent w/V polypropylene/xylene solution onto the plate agitated at a frequency of 50 Hz and a displacement of about 0.3 inch (0.762 cm). For any given application of solution, a gelatinous sheet formed within a period of 10 to 15 seconds. The wet fabric could be easily slid or lifted from the surface of the plate. The process could be repeated successively to produce sheets.

The sheets were thicker than the sheets produced on the smaller coupon and appeared to have good integrity when wet with xylene or acetone. A sheet soaked overnight in acetone had a strength similar to that of wet cardboard. A sheet subjected to a soxhlet extraction and air drying appeared to be brittle and have little strength. SEM examination revealed the sheet to have a low fiber content. The higher fiber content of the tough sheet produced on the coupon is believed due to the higher flow field applied to the very thin film solution.

EXAMPLE 4

Experiments were also run with a crudely fractionated polymer blend of polypropylene and polyethylene. The purpose of these experiments was twofold. First, the fractionation will produce an increased concentration of high molecular weight molecules. Polymer molecular theories teach that the larger the molecule, the more flexible and extensible it is in terms of molecular uncoiling and, thus, the more responsive to molecular perturbing and deforming velocity gradients. Second, adding a small amount of polyethylene to the polypropylene should lower the thermodynamic rate of crystallization of the latter and, thus, increase the chance for the flow field to have its molecular perturbing effects.

A mixture of 2 percent w/V polypropylene and 1 percent w/V polyethylene in 250 ml of xylene was heated intermittently to a series of temperatures, 75°, 87°, 95°, 105°, and 115° C. At each temperature following a 30-minute dissolution period, 100 ml of the liquid was decanted and 100 ml of fresh xylene added to the mixture. Finally, the 115° C. mixture/soluton was heated to 125° C. to effect dissolution of the remaining polymer.

The hot polypropylene/polyethylene/xylene solution was applied to the aluminum plate undergoing agitation as in Example 3. Again, sheets of fabric were produced which could be lifted from the plate and which in the wet condition had significantly more structural integrity than an ordinary, moistened tissue, for example. Upon extraction with acetone and air drying, a material resulted with improved flexibility and porosity compared to the sheet of Example 3. Scanning electron microscopic examination revealed a fabric with higher fiber content than that of Example 3. However, the material still was not as strong or tough as desired; it easily pulled apart.

The flow dynamics needed to produce high tensile strength fabric was not achieved. As discussed earlier, velocity gradients within the solution are believed to be required to produce molecular uncoiling and orientation and, eventually, fiber crystallization. Apparently, the grooves in the surface of the plate of FIG. 5 did not generate the flow necessary to produce the required velocity gradients in the layer of solution. Perhaps this is understandable since the ridge area is much greater than the groove area.

EXAMPLE 5

Figure 6A:
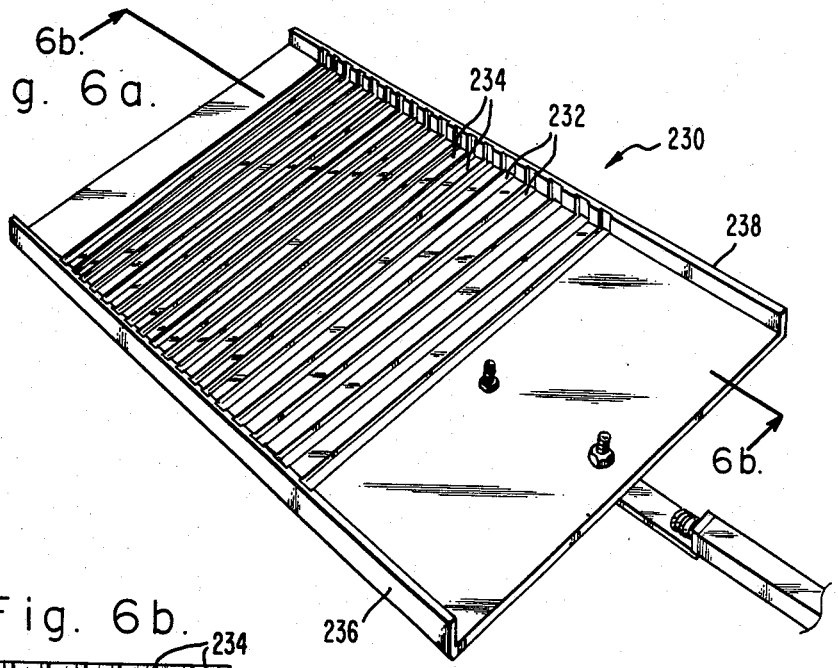
FIG. 6*a*–6*b* is a top view of a further grooved substrate for forming thin film fiberized sheets.
Figure 6B:
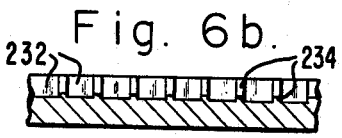

The plate 230 as shown in FIG. 6 has a surface in which the groove area 232 is greater than that of the ridges 234 and should produce a greater effect on the streaming of the solution than the plate of FIG. 5 used in Examples 3 and 4. The ratio of groove area to the ridge area is preferably at least 3/2. The height of the ridges should be sufficient to generate turbulent flow in the grooves and is usually at least ½ to 1/5 times the width of the grooves. Referring again to FIG. 6, a 3×8 inch (7.62×20.32 cm) aluminum plate 230 was machined to form ridges 234 which were 0.025 inch (0.635 mm) high, 0.04 inch (1.016 mm) wide and separated by a groove distance of 0.16 inch (4.064 mm). The sides were bent to form side walls 236, 238. The plate was attached to the MB Electronics exciter positioned on its side to allow horizontal agitation as in the previous experiments.

An experiment was performed using a standard 2 percent w/V polypropylene/xylene solution and the ridged agitation plate. An excess of the solution, at a temperature of 120° C., was poured quickly onto the surface of the plate of FIG. 6. The excess overflowed the end of the plate. During application of the solution, the plate was undergoing agitation at a frequency of 50 Hz and a displacement of about 0.3 inch (0.762 cm). Sheet material formed in about 15 to 20 seconds. The sheet produced was significantly superior in properties as compared to sheets produced on the prior surfaces.

Figure 7:
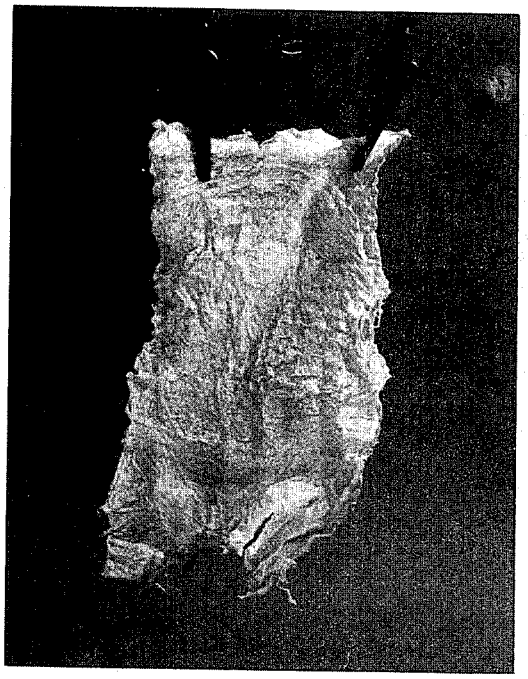
FIG. 7 shows a photograph of a fibrous sheet of polypropylene produced in accordance with the present invention using the grooved substrate shown in FIG. 6.
Figure 8A:
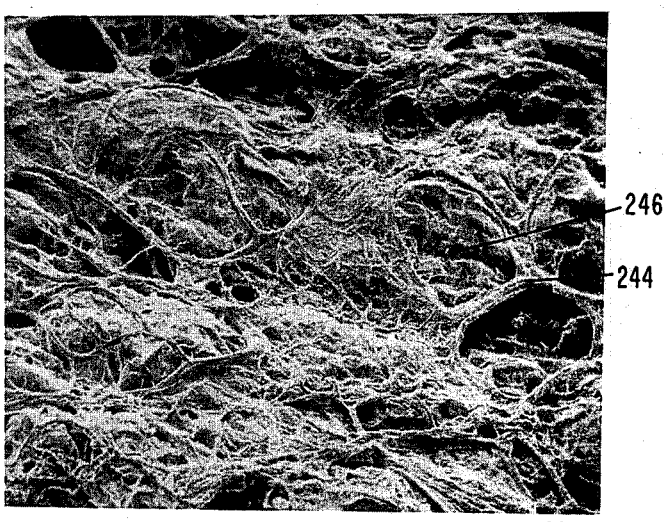
FIG. 8*a*–8*b* shows two scanning electron microscope photographs of the fibrous sheet of polypropylene produced using the substrate of FIG. 6.
Figure 8B:
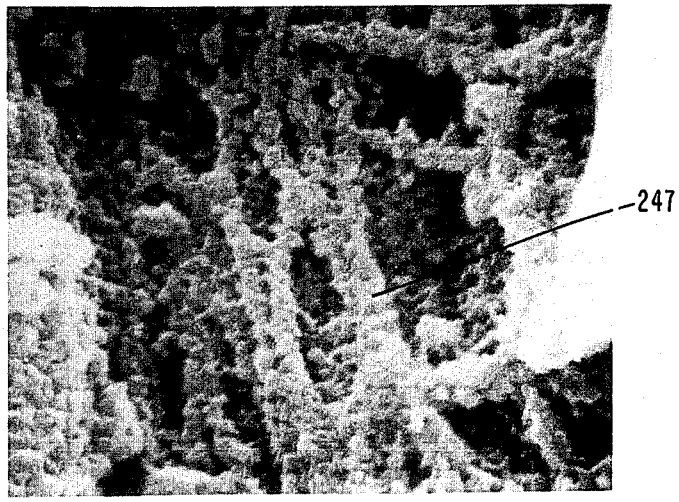

As shown in FIG. 7, which presents a photograph of the sheet of Example 5 while it was still wet with xylene and acetone, the sheet appeared to have high fiber content and considerable strength. This sheet when dried was relatively soft, flexible and tough as judged by handling. The fine structure of the material was revealed by SEM photos at 20X, and 5000X magnifications. At 20X, as shown in FIG. 8*a*, the material appears to be a rather dense network of interconnected fiber 244 webbed with film material 246. However, examination of the photo at 5000X in FIG. 8*b* reveals the apparent film material to be a dense packing of very fine, interconnected fibrils 247 that are connected to the network of larger interconnected fibers. The network fibers have a much larger diameter than produced by bulk in-situ fiberization, generally from 10 to 100 times larger in diameter. Thus, the sheet comprises a composite of an open matrix of coarse fibers extending throughout the sheet which is integrated with co-crystallized, fine fibers spanning the open spaces within the matrix of the coarse fibers. The fibrils are 10 to at least 50 times smaller than the fiber network.

EXAMPLE 6

High molecular weight (HMW) fractions of polypropylene were prepared for thin film agitation ISF experiments. The fractions were prepared by fiberizing wire screens by bulk in-situ fiberization techniques in 2 percent w/V polypropylene/xylene solutions at 101° C. Subsequently, the fiberized material was redissolved to yield a 0.5 percent w/V solution of the HMW material; higher concentrations were not achievable. SEM photos of the HMW product produced by the thin film agitation processing generally show the HMW material as being more uniform in texture and perhaps higher in fiber content than the standard polymer material produced in Example 5. The nonfibrous material appears to be film-like rather than flocculated as observed with the standard material.

The sheet obtained with the ridged plate of FIG. 6 with wider channels was much improved in terms of handleability (i.e. flexibility, mechanical integrity, and softness to the touch) and fiber structure than the sheets produced on the prior plates.

EXAMPLE 7

It was desirable to further improve the strength, flexibility and porosity of the sheet. This can be achieved by increasing the fiber content and increasing the diameter and length of fibers between network junctures. Flow dynamics considerations dictate that the pattern on the substrate surface for optimum fiberization should induce maximum flow field intensity, i.e., maximum velocity gradient, throughout the layer of solution by appropriate design of the size, shape and separation of the grooves and ridges.

It was then attempted to increase the groove area and volume by providing a patterned plate having one set of grooves running in the direction of agitation and a second set of grooves running in a direction normal to the first set of grooves. These grooves are defined by a pattern of raised protrusions formed by machining an aluminum plate to provide a cleated surface, as shown in FIG. 9. Fluid dynamic considerations indicate that flow field intensity is increased by forming turbulent vortices via a substrate having a pattern of raised protrusions in which one set of grooves is discontinuous due to the offset placement or staggered arrangement of alternate rows of protrusions in the direction of reciprocation. Thus, the substrate has one set of continuous grooves running in a direction perpendicular to the direction of reciprocation of the substrate and a set of discontinuous grooves running in a direction parallel to the direction of reciprocation. The protrusions act as baffles in the direction of agitation, localizing fluid turbulence in the channels surrounding the protrusion, which fosters denser and stronger fiber network formation in the channels. This fiber network is a rough positive replication of the channel pattern and extends throughout the sheet as a form of in-situ generated reinforcing matrix, which is evident on visible inspection of the sheet. Depending on the thickness of the sheet formed, the sheet may be textured on one or both surfaces.

The effect of the dimensions of the protrusions was analyzed. The magnitude of the velocity gradient is proportional to the height of the protrusion as long as the thickness of the fluid exceeds the height of the protrusion so that the solution flows over the protrusions.

Referring now to FIG. 10, the protrusions 250 are provided in rows 1, 3, 5 which alternate with the protrusions 252 in rows 2, 4, etc. The protrusions in the even numbered rows are offset or staggered with respect to the protrusions in the odd numbered rows. The protrusions can be of any geometry but are conveniently formed of rectangular cleats and are disposed with the longest dimension perpendicular to the direction of reciprocation (indicated as "A" in FIG. 10). The protrusions 252 block the channel 254 between the adjacent protrusions 250 in a given row, such as row 1, which would otherwise extend across each successive row. The distance $L_2$ between cleats in a given row is at least 1.5 times the width W of the cleats. The length $L_1$ of the cleats is no less than the distance $L_2$, and the height H is usually at least as large as the width W. The distance $D_2$ between cleats in odd-numbered (or even-numbered) rows is at least 3 times the width W and the distance $D_1$ between cleats in adjacent rows is at least 1.5 times the width W.

Sheets were formed as described in greater detail below, on an oscillating plate having a cleat pattern in a system in which reservoirs of hot polymer solution and xylene are positioned above the shaker system as shown in FIG. 3. Heat traced copper tubing carries the hot solution or solvent rinse to the fiberization plate. The liquids are dispensed by means of a fan-shaped applicator.

Sheets were formed by dispensing a 2 percent w/V polypropylene/xylene solution at 125° C. onto a patterned plate as shown in FIGS. 9 and 10, having length (L), width (W), and height (H) dimensions:

$W = 0.032$ inch (0.081 cm)

$H = W$ $L_1 = L_2 = 2W$ $D_1 = 2W$ $D_2 = 5W$

Figure 11:
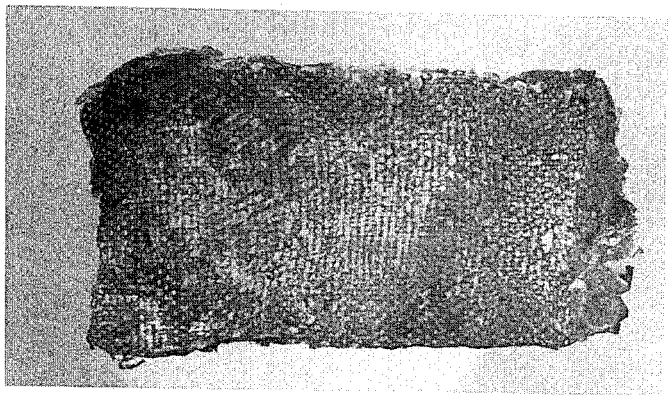
FIG. 11 shows a photograph of a fibrous sheet of polypropylene produced in accordance with the present invention using the patterned substrate shown in FIG. 9.
Figure 12A:
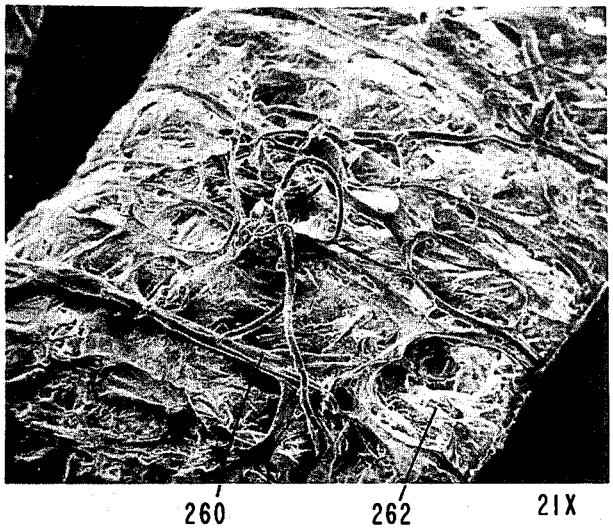
FIG. 12*a*–12*d* presents four scanning electron microscope photographs of a fibrous sheet of polypropylene produced using the substrate of FIG. 9.
Figure 12B:
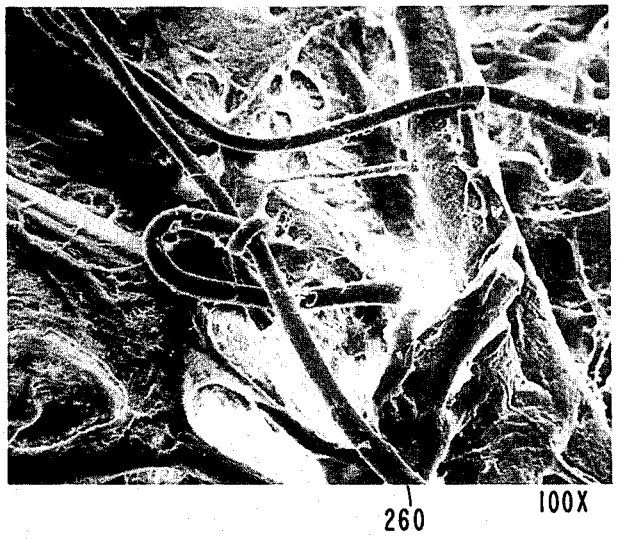
Figure 12C:
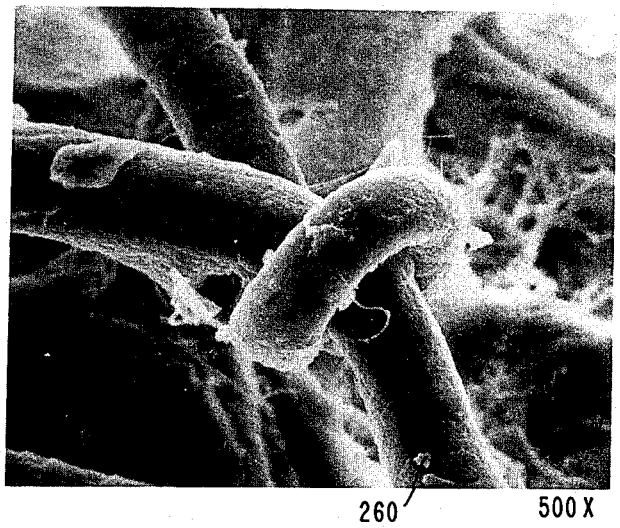
Figure 12D:
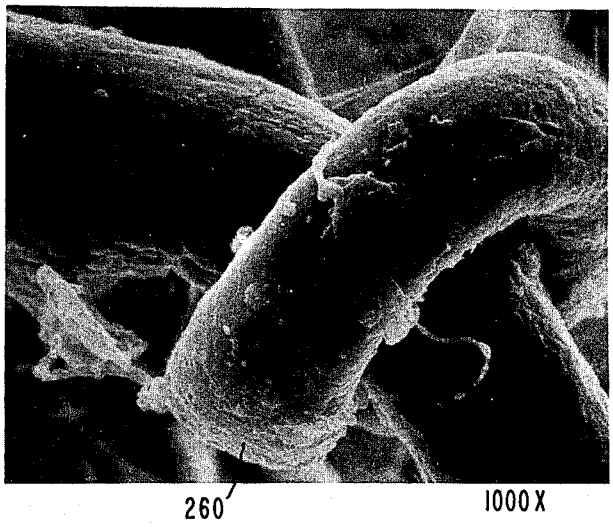

A photograph of the sheet material produced using the patterned substrate of FIG. 9 is shown in FIG. 11. This material was found to have good fiber content, porosity and strength. As shown in the SEM photographs of FIGS. 12*a* and 12*b* at 20X and 100X, the sheet appears to have a coarse network ground 260 bridged with finer fiber damask networks 262 through molecular interconnection. The coarse network 260 appears to replicate the pattern of channels. FIGS. 12*c* and 12*d* show the structure of this material at 500X and 1000X magnification.

The fabric had a density of less than 0.5 ounces/yard$^2$ with pores of about 1 mm.

Other patterns of fiber networks may be formed by adjusting the shape and size of the cleats, as well as the angular orientation of the cleats in alternate rows with respect to each other or with respect to the direction of agitation.

EXAMPLE 8

The process of Example 7 was repeated except that the 2 percent w/V solution contained polypropylene/polyethylene in a ratio of 2/1. The fiber content of the sheet increased, especially the fine damask networks between the large ground fibers.

EXAMPLE 9

The process of Example 7 was repeated utilizing a 1.0 percent w/V solution of polypropylene. SEM photographs indicate a less dense fiber network than that of Example 7.

EXAMPLE 10

The process of Example 7 was repeated using an 0.5 percent w/V solution of polypropylene. The fiber density was again lower than the sheet of Example 9.

EXAMPLE 11

A plate was prepared in which the height of the cleats was increased in order to develop more turbulence for a given set of agitation conditions. The plate had the following dimensions:

$W = 0.025$ inch (0.063 cm)

$H = 2W$ $L_1 = 2W$ $D_1 = 2W$ $D_2 = 5W$

A sheet was prepared by dispensing a 2 percent w/V polypropylene solution at 125° C. onto the plate agitated as in previous experiments. A stronger sheet with a more pronounced large fiber network replicating the cleat pattern was produced.

It is to be realized that only preferred embodiments of the invention have been described and that numerous substitutions, modifications and alterations are permissable without departing from the intention and scope of the invention as defined in the claims. In particular, the present invention is not limited to the specific polymer solutions set forth in the examples, but includes all polymer materials which are capable of in-situ fiberization. Further, the present invention is not limited to the particular process details set forth herein as examples, but includes the modification of such process details as required in order to accomplish the in-situ fiberization process described herein. In particular, it is contemplated that the pattern of grooves or cleats on the substrate may be modified to provide a desired pattern in the fiber network of the formed sheet. Finally, the present invention is not limited to the particular apparatus described herein in detail, but includes any suitable apparatus for accomplishing the in-situ fiberization process described herein.

What is claimed is:

1. A system for forming a fibrous polymeric sheet comprising in combination:

(a) a substrate having a surface for forming the sheet;

(b) means for agitating the substrate;

(c) dispensing means for forming a film of polymer solution on the surface of the substrate; and (d) means for removing the sheet from the surface of the substrate, wherein the agitation is applied to the substrate in reciprocating movement, and the surface of the substrate is roughened and discontinuous, and contains a set of parallel continuous grooves.

2. A system according to claim 1 in which the surface contains edge runners for retaining the film on the surface.

3. A system according to claim 1 further including means for applying a solvent to the sheet.

4. A system according to claim 1 further including means for drying the sheet.

5. A system according to claim 1 in which the substrate is in the form of a continuous moving loop disposed below the dispensing means.

6. A system according to claim 1 further including a carrier for mounting the dispensing means and the removal means, and a translation means connected to the carrier for repetitively translating the carrier across the surface of the substrate.

7. A system according to claim 1 in which the parallel continuous grooves extend through the length of the substrate in the direction perpendicular to the direction of reciprocation.

8. A system for forming a fibrous polymeric sheet comprising in combination:

(a) a substrate having a surface for forming the sheet wherein the surface of the substrate is roughened and discontinuous, and contains sets of grooves in first and second directions forming a pattern of raised protrusions, the area of the grooves exceeds the non-grooved area, the protrusions are located in rows such that the protrusions in the even rows are offset by protrusions in the odd rows;

(b) means for agitating the substrate;

(c) dispensing means for forming a film of polymer solution on the surface of the substrate; and (d) means for removing the sheet from the surface of the substrate, wherein agitation is applied to the substrate by reciprocating movement and the protrusions are rectangular in shape and are disposed with the length thereof normal to the direction of reciprocation of said substrate such that continuous grooves run in the direction perpendicular to the direction of reciprocation and discontinuous grooves run in the direction parallel to the direction of reciprocation.

9. A system according to claim 8 in which the grooves are at least 0.01 inch (0.0254 cm) deep.

10. A system for forming a fibrous polymeric sheet comprising in combination:

(a) a substrate having a surface for forming the sheet wherein the surface of the substrate is roughened and discontinuous, and contains sets of grooves formed from raised protrusions, the area of the grooves exceeds the area of the protrusions, the protrusions are located in a pattern;

(b) means for agitating the substrate;

(c) dispensing means for forming a film of polymer solution on the surface of the substrate; and (d) means for removing the sheet from the surface of the substrate, wherein the agitation is applied to the substrate by reciprocating movement and the protrusions form continuous grooves in one direction and discontinuous grooves in another direction.

11. A system according to claim 10 in which the continuous grooves are perpendicular to the discontinuous grooves.

12. A system according to claim 10 in which the continuous rows run in the direction perpendicular to the direction of reciprocation and the discontinuous rows run in the direction parallel to the direction of reciprocation.

* * * * *